US005226380A

United States Patent [19]

Fischer

[11] Patent Number: 5,226,380

[45] Date of Patent: Jul. 13, 1993

[54] MARINE ORGANISM REPELLENT COVERING FOR PROTECTION OF UNDERWATER OBJECTS AND METHOD OF APPLYING SAME

[76] Inventor: Kenneth J. Fischer, 208 32nd St., NW., Canton, Ohio 44709

[21] Appl. No.: 959,366

[22] Filed: Oct. 13, 1992

Related U.S. Application Data

[63] Continuation-in-part of Ser. No. 806,242, Dec. 13, 1991, abandoned.

[51] Int. Cl.[5] ..... B63B 59/00

[52] U.S. Cl. ..... 114/222; 138/146; 405/216

[58] Field of Search ..... 422/6; 405/216; 114/222, 356, 67 R; 138/145, 146

[56] References Cited

U.S. PATENT DOCUMENTS

| | | | |
|---|---|---|---|
| 3,027,610 | 4/1962 | Liddell | 114/222 |
| 3,142,283 | 7/1964 | Fisher | 114/222 |
| 3,497,990 | 3/1970 | Jeffries | 43/131 |
| 3,761,334 | 9/1973 | Zondek | 156/71 |
| 3,870,009 | 3/1975 | Liddell | 114/222 |
| 4,026,233 | 5/1977 | Cox | 114/229 |
| 4,280,438 | 7/1981 | Jackson | 114/222 |
| 4,282,822 | 8/1981 | Jackson | 114/222 |
| 4,375,199 | 3/1983 | Graeme-Barber | 114/222 |
| 4,603,653 | 8/1986 | Bews | 114/222 X |
| 4,693,200 | 9/1987 | Noble | 114/47 |

FOREIGN PATENT DOCUMENTS

| | | | |
|---|---|---|---|
| 26082 | 2/1982 | Japan | 114/222 |
| 2148803 | 6/1985 | United Kingdom | 114/222 |
| 2154514 | 9/1985 | United Kingdom | 114/222 |
| 8912144 | 12/1989 | World Int. Prop. O. | 114/222 |

*Primary Examiner*—Sherman Basinger

*Attorney, Agent, or Firm*—Paul E. Milliken; Lee A. Germain

[57] ABSTRACT

A covering material for underwater objects such as boat hulls or water intake pipes. The covering includes a waterproof coating such as adhesive or paint containing capsicum derivatives such as cayenne pepper or oleoresin capsicum, with the coating applied to the outer surface of the object to be protected, to repel marine organisms which might otherwise attach themselves to the object. In some applications copper material may also be applied to the coating.

29 Claims, 3 Drawing Sheets

MARINE ORGANISM REPELLENT COVERING FOR PROTECTION OF UNDERWATER OBJECTS AND METHOD OF APPLYING SAME

This in a continuation-in-part of Ser. No. 07/806,242 Filed Dec. 13, 1991, which is now abandoned.

FIELD OF THE INVENTION

This invention relates generally to a covering for anti-fouling protection of underwater objects and more specifically to a coating which can be applied to underwater objects such as boat hulls or water intake pipes to prevent the build-up of marine organisms on the surfaces of such objects and a method for applying such coating. The coating contains capsicum derivatives such as cayenne pepper or oleoresin capsicum to repel the organisms which might otherwise attach themselves to submerged objects.

BACKGROUND OF THE INVENTION

In the past many different products and processes have been tried in an attempt to prevent the build-up of marine organisms such as barnacles, zebra mussels and the like on the surfaces of underwater objects such as boat hulls, docks and water supply intake pipes. This has been a problem both in salt water in the oceans and in fresh water such as that found in the Great Lakes.

One example of such prior art anti-fouling device is shown in U.S. Pat. No. 3,497,990 issued to F. A. Jeffries in which a layer of foam material having interconnected cells is used as a storage layer for anti-fouling compounds such as bis (tri-n butyl tin oxide) which slowly seeps out through a permeable outer cover layer to prevent the growth of marine organisms on any underwater surface to which it is attached.

Well known anti-fouling paints are also frequently used with varying degrees of success. One of the primary defects of such paints is the short foul-free life. Secondly the paints lack durability and have low abrasion resistance. Many paints have unfavorable compatibility with the surfaces on which they are used and tend to magnify electrolytic corrosion when used over metallic surfaces U.S. Pat. No. 3,761,334 issued to K. Zondek shows another approach to the anti-fouling problem in which copper foil is attached to a boat hull with adhesive.

Other patents such as U.S. Pat. No. 3,142,283 issued to T. A. Fisher show a boat hull enclosed by a loose cover which has either fresh water or chemical inhibitor pumped into the space between the cover and the hull. While such a concept might be used with a moored boat it would not be practical to use with a moving boat.

My copending patent application Ser. No. 754,069 filed Sep. 3, 1991 which is now abandoned discloses a removeable waterproof cover for anti-fouling protection which can be easily removed and replaced if the need arises. This invention is a further development from the invention in my prior application.

OBJECTS OF THE INVENTION

It is a primary object of the invention to provide an easily applied covering for underwater objects to prevent surface build-up of marine organisms thereon and which cover can be easily refurbished if, over an extended period of time it becomes less effective for repelling marine organisms from its surface.

Another object of the invention is to provide a simple inexpensive covering for underwater objects which is easy to apply with a minimum of equipment.

A still further object of the invention is to provide an anti-fouling cover which is useful in either salt water or fresh water applications.

An even further object of the invention is to provide an anti-fouling cover which will comply with EPA standards and which uses no tributytin toxicant.

These and other objects of the invention will become more fully apparent in the following specification and the attached drawings.

SUMMARY OF THE INVENTION

This invention is a protective covering for repelling marine organisms from the exterior of submerged objects comprising: a waterproof coating formulated to withstand continual submersion under water; the waterproof coating containing a capsicum derivative material; the capsicum derivative having repellent properties which create a hostile environment for marine organisms in the area of the submerged object to be protected which would otherwise attach themselves to the object to be protected.

DESCRIPTION OF THE PREFERRED EMBODIMENTS

Figure 1:
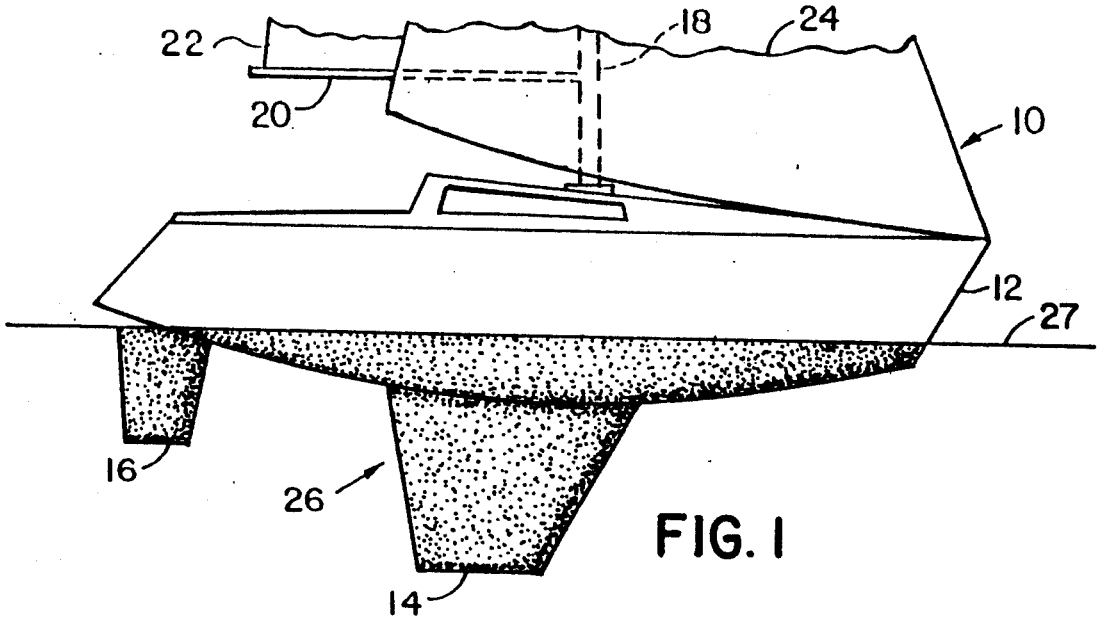
FIG. 1 is a fragmentary side elevational view of a sailboat showing one embodiment of the invention applied to the hull thereof.

Referring now to the drawings and in particular to FIG. 1, a sailboat indicated generally by the numeral 10 has a hull 12, a keel 14, a rudder 16, a mast 18, a boom 20, a mainsail 22, and a genoa 24. The covering material of the invention is indicated generally by the numeral 26 and is applied in a manner which will be described later herein, to all surfaces of the boat 10 below the waterline 27.

Figure 2:
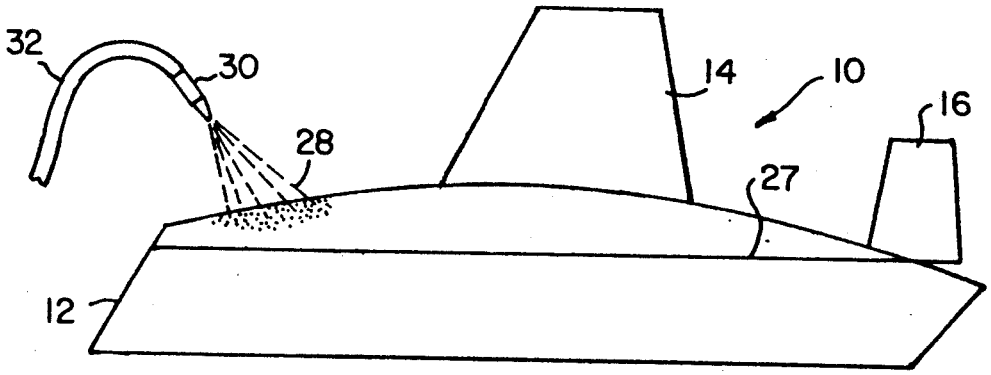
FIG. 2 is a side elevation view of a sailboat turned upside down being sprayed with adhesive.

As shown in FIG. 2 a sailboat 10 which is turned upside down is being sprayed with adhesive 28 from a spray nozzle 30 connected to an adhesive supply hose 32. All the portions of the boat 10 below the waterline 27 are coated with a layer of the adhesive 28 to form a retaining matrix for anti-fouling materials in various forms or configurations. The adhesive may be any type of waterproof adhesive with long durability when submerged either in salt water or fresh water. One preferred type of adhesive is acrylic, however others may also be quite satisfactory.

Figure 3:
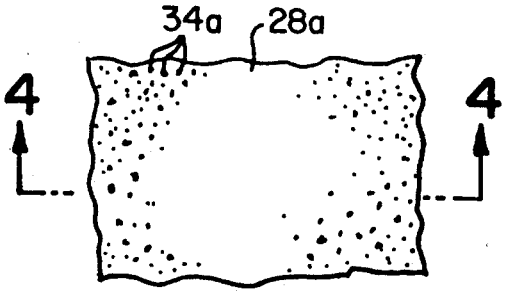
FIG. 3 is a fragmentary view of a portion of a boat hull showing one embodiment of the invention.
Figure 4:
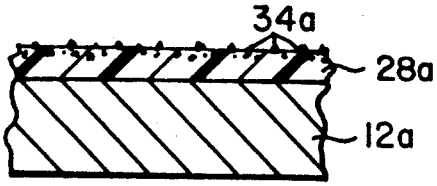
FIG. 4 is a cross-sectional view taken on line 4—4 of FIG. 3.

A primary embodiment of the invention is shown in FIGS. 3 and 4 in which a boat hull **12*a* is coated with an adhesive layer 28*a* by spraying as shown in FIG. 2 or by other suitable means. While the adhesive is still in the uncured state, a deposit of particles of cayenne pepper 34*a* (also called "red pepper") is applied to the adhesive layer. Some of the cayenne pepper particles 34*a* may be completely coated or enveloped by the adhesive. Other particles may be only partially coated with the adhesive but will be retained on the outer surface of the hull 12*a* by the adhesive. The intense heat of the cayenne pepper 34*a*** provides an extremely hostile environment for any marine organism that might otherwise attach to the surface. Cayenne pepper emits a burning or irritating property which actually burns human skin when contacted thereby and will repel living organisms such as barnacles, zebra mussels and other marine organisms which would otherwise attach themselves to underwater surfaces of boats, water supply intake pipes and the like. Over an extended period of time, if the repellent properties of the cayenne pepper diminish to the point where any build-up of organisms appears on the surface being protected, the surface may be recoated if necessary.

Figure 5:
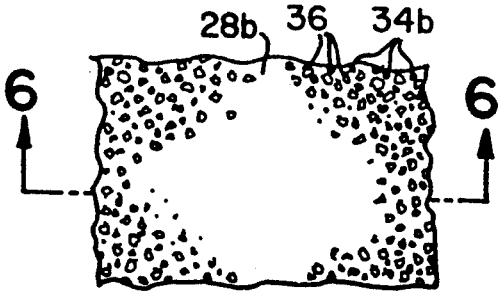
FIG. 5 is a fragmentary view of a boat hull showing another embodiment of the invention using copper granules in the covering material.
Figure 6:
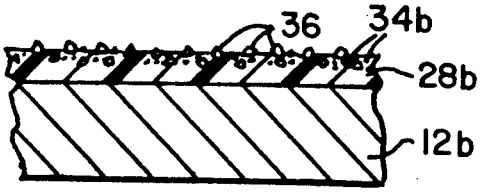
FIG. 6 is a cross-sectional view taken of line 6—6 of FIG. 5.

FIGS. 5 and 6 show another embodiment of the invention in which a layer of adhesive **28*b* is a applied to a boat hull 12*b*. A deposit of particles of cayenne pepper 34*b* is applied to the adhesive layer 28*b* in the same manner as previously described with regard to FIGS. 3 and 4. A layer of copper granules 36 is them applied to the adhesive layer. The granules 36 are applied to the adhesive layer 28*b* in sufficient density as to substantially cover the entire surface of the boat hull 12*b* while leaving sufficient spacing between the copper granules 36 to form a permeable layer through which the repellent properties of the cayenne pepper 34*b* can diffuse and in cooperation with the copper granules 36 provide additional protection for the boat hull 12*b***.

Figure 7:
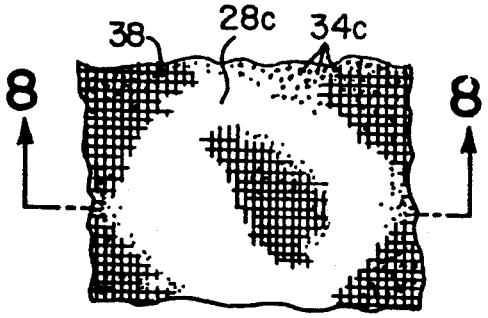
FIG. 7 is a fragmentary view of a boat hull showing another embodiment of the invention using copper screen in the covering material.
Figure 8:
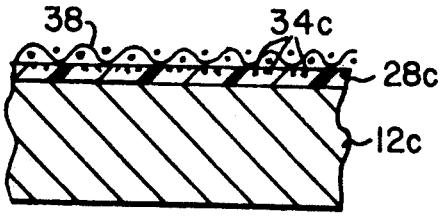
FIG. 8 is a cross-sectional view taken on line 8—8 of FIG. 7.

FIGS. 7 and 8 show another embodiment of the invention in which a layer of adhesive **28*c* is applied to a boat hull 12*c* and deposit of cayenne pepper 34*c* is applied to the adhesive 28*c*. A layer 38 of copper wire screen is then applied to the adhesive layer 28*c*. When some types of adhesives are used, the adhesive penetrates through the interstices of the screen 38 and firmly locks the screen to the boat hull 12*c*. The copper screen 38 and the cayenne pepper 34*c* will provide an environment which is undesirable for marine organisms and therefore will prevent a build-up of such organisms on the outer surface of the boat hull 12*c***.

Figure 9:
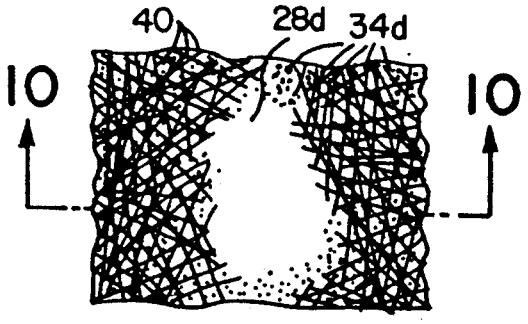
FIG. 9 is a fragmentary view of a boat hull showing another embodiment of the covering using an unwoven mat of random copper wires in the covering material.
Figure 10:
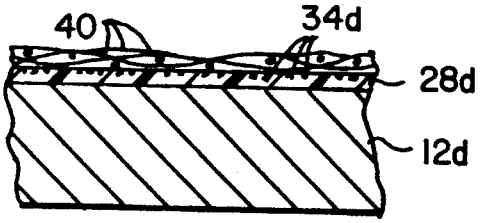
FIG. 10 is a cross-sectional view taken on line 10—10 of FIG. 9.

Another embodiment of the invention is shown in FIGS. 9 and 10 in which an adhesive layer **28*d* is applied to a boat hull 12*d* and then a deposit of cayenne pepper 34*d* followed by an unwoven mat of randomly oriented copper wires 40 held in place by the adhesive layer 28*d***.

Figure 11:
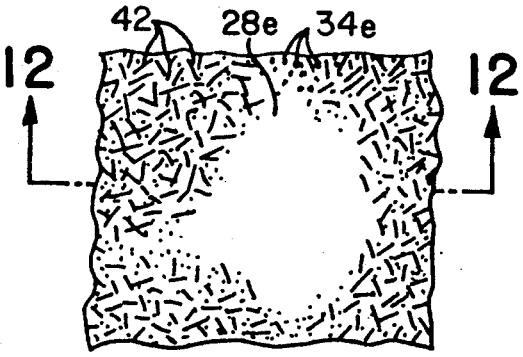
FIG. 11 is a fragmentary view of a boat hull showing another embodiment of the covering using short lengths of copper wire in random orientation in the covering material.
Figure 12:
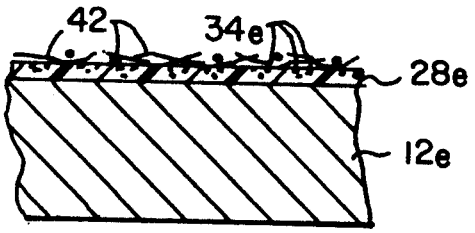
FIG. 12 is a cross-sectional view taken on line 12—12 of FIG. 11.

FIGS. 11 and 12 show another variation in which a boat hull **12*e* is coated with an adhesive layer 28*e* and then followed by applications of cayenne pepper 34*e* and short chopped lengths of copper wire 42 deposited in random orientation on the adhesive layer 28*e***.

In any of the embodiments shown in FIGS. 5 through 12 the repellent properties of the cayenne pepper diffuses or migrates out through a permeable layer of copper applied in various configurations and cooperates with the repellent properties of the copper to provide increased anti-fouling protection for the surface to which it is applied.

Figure 13:
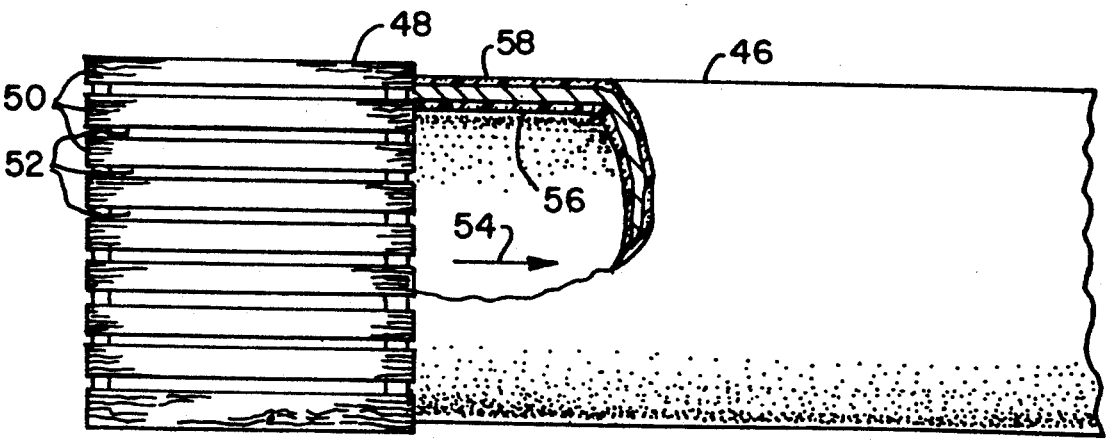
FIG. 13 is a fragmentary side elevational view of a water supply intake pipe with a crib on the inlet end illustrating another embodiment of the invention.

The anti-foulant covering configurations shown in any of the FIGS. 3 through 12 can also be used on other under water surfaces such as the water supply intake pipe 46 shown in FIG. 13. The pipe 46 can be located beneath the water on the bottom of oceans or inland lakes or other bodies of water. Even when located in freshwater lakes such as the Great Lakes, organisms such as the zebra mussel attach themselves to both the inside and outside of the pipe and not only clog the pipe to block the flow of water but also corrode the pipe enough to cause holes in the pipe over a period of time. The pipe 46 is typically a steel conduit which may be 5 or 6 feet, (1.52 or 1.83 m) in diameter or more.

The intake end of the pipe 46 is covered by a wooden crib 48 which is a lattice-like structure which keeps fish, logs and other debris from entering the intake pipes. The crib 48 is comprised of a series of wooden slats 50 with spaces 52 therebetween to permit the water to flow through into the intake pipe 46 in the direction of the arrow 54 while screening out debris and objects in the water from being drawn into the intake pipe 46 and thereby clog up the pipe. The zebra mussels not only attach themselves to the intake pipes but also attach themselves to the cribs and can clog up the spaces between the slats and block the flow of water into the pipes. The intake pipe in FIG. 13 is shown with its inside surface covered with an anti-fouling covering 56 and its outside surface covered with a similar anti-fouling covering 58. The anti-fouling covering used on the pipe 46 is shown as the same covering illustrated in FIGS. 3 and 4, however any of the other covering configurations can also be used. The slats 50 of the crib 48 can also be covered on both sides by the same anti-fouling covering material used on the inside and outside surfaces of the pipe 46.

Figure 14:
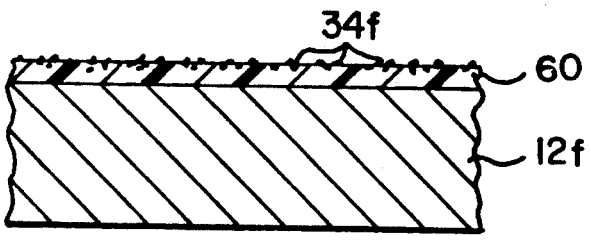
FIG. 14 is a fragmentary cross-sectional view of a boat hull showing another embodiment of the invention.

FIG. 14 shows another embodiment of the invention which is similar to the embodiment in FIGS. 3 and 4. In FIG. 14 a boat hull **12*f* is coated with a layer of waterproof immersible paint 60 such as an epoxy-polyamide paint as described in MilSpec MIL-P-24441A (SH) and while the paint is wet a deposit of particulate cayenne pepper 34*f* is applied. The cayenne pepper can be sprinkled or blown on the surface or applied in any other suitable manner. The paint serves the dual function of an adhesive for the cayenne pepper and a waterproof protective coating for the surface of the boat hull 12***f*. Other coatings such as immersible polyurethane compounds may also be used in the same manner as the expoxy-polyamide paint.

Figure 15:
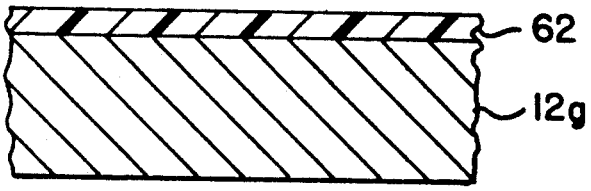
FIG. 15 is a fragmentary cross-sectional view of a boat hull showing another embodiment of the invention in which the hull is coated with an ablative paint.

FIG. 15 shows a boat hull 12*g* which is coated with a layer of ablative paint 62 of the type described in Mil-Spec MIL-P-15931C except that in many applications, cuprous oxide has been eliminated from the formulation. Intermixed with the ablative paint is a quantity of oleoresin capsicum also called oleoresin red pepper which may be of the type produced by McCormick & Company, Inc. and identified as formula #608229. Oleoresin capsicum can be obtained in various heat units depending upon the particular application for which it is to be used, and the heat generated by this product when mixed with an ablative paint creates a hostile environment to marine organisms which approach a submerged surface painted with such paint and repels the organisms from the surface without creating a toxic condition in the water surrounding the surface. Other derivatives of capsicum can also be mixed with an ablative paint to provide a repellent covering for underwater surfaces.

For the purpose of illustrating the invention, the anti-foulant materials such as the copper and cayenne pepper are show as being applied after the adhesive layer is applied to the surface to be protected. It is also possible, if desired, to mix at least part of the anti-fouling materials with the adhesive and apply them both simultaneously. For example a dual orifice nozzle can spray adhesive from one orifice and cayenne pepper from an adjacent orifice and they can be mixed together either in the nozzle or in the stream emitted from the nozzle.

Figure 16:
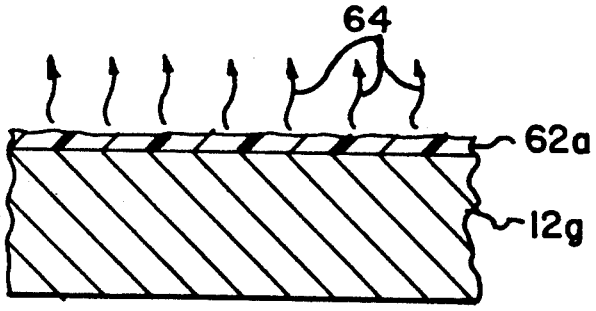
FIG. 16 is a fragmentary cross-sectional view of the embodiment shown in FIG. 15 after some of the ablative paint has leached away in water leaving a thinner layer of paint.

FIG. 16 shows another view of the boat hull 12*g* after a portion of the ablative paint has leached away leaving a thinner layer of paint 62*a* and exposing additional amounts of the oleoresin capsicum to the outer surface of the remaining paint which releases heat 64 to repel marine organisms in the vicinity of the surface. By using ablative paint new amounts of oleoresin are continually exposed as the paint leaches away. Other derivatives of capsicum may also be used in a mixture with the ablative paint.

While certain types of copper layer configurations are shown for the purpose of illustrating the invention, various other copper configuration and other organism repellents can be used without departing from the scope of the invention.

I claim:

1. A method of protecting the surface of underwater objects from fouling by growth of marine organisms thereon comprising the steps of:

(A) applying a layer of waterproof adhesive to the surface to be protected;

(B) applying to the waterproof adhesive layer, a deposit of cayenne pepper material; and (C) applying a permeable layer of copper containing material to the adhesive layer in such a configuration as to leave certain areas of the outer surface of the adhesive layer exposed, through open portions of the permeable layer, to the ambient environment of the surface to be protected when such surface is submerged in water;

(D) the permeable layer having the property of being a repellent to marine organisms.

2. The method as claimed in claim 1 wherein the cayenne pepper material applied to the waterproof adhesive layer is in particulate form.

3. The method as claimed in claim 1 wherein the cayenne pepper material is mixed with the waterproof adhesive prior to the step of applying the layer of adhesive to the surface to be protected.

4. The method as claimed in claim 1 wherein the repellent properties of the cayenne pepper material diffuse through the permeable layer and cooperate with the repellent properties of the permeable layer to intensify the hostile environment for marine organisms on the surface to be protected.

5. The method as claimed in claim 1 wherein the adhesive is an acrylic material.

6. The method as claimed in claim 1 wherein the permeable layer is comprised of copper granules.

7. The method as claimed in claim 1 wherein the permeable layer is comprised of copper wire mesh screen.

8. The method as claimed in claim 1 wherein the permeable layer is comprised of a non-woven mat of copper wires in a random pattern.

9. The method as claimed in claim 1 wherein the permeable layer is comprised of short lengths of copper wire deposited in random orientation on the waterproof adhesive layer.

10. An anti-fouling covering for preventing the growth of marine organisms on the exterior of submerged objects comprising:

(A) a waterproof adhesive layer including cayenne pepper material having the property of being repellent to marine organisms, said layer covering the surface to be protected when submerged underwater; and (B) a permeable layer of copper containing material attached to the outer surface of the adhesive layer and retained thereby on the surface to be protected;

(C) the permeable layer being of such a configuration as to leave certain areas of the outer surface of the adhesive layer exposed to the ambient environment of the submerged object through open portions of the permeable layer;

(D) said permeable layer having the property of being repellent to marine organisms.

11. An anti-fouling covering as claimed in claim 10 wherein the cayenne pepper material in the waterproof adhesive layer is a particulate material at least partly embedded therein and lying beneath the permeable layer.

12. An anti-fouling covering as claimed in claim 11 wherein the repellent properties of the cayenne pepper material react through interstices of the permeable layer in combination with the repellent properties of the permeable layer to intensify the hostile environment for marine organisms on the surface to be protected.

13. An anti-fouling covering as claimed in claim 10 wherein the permeable layer is at least partly imbedded in the waterproof adhesive layer and the adhesive layer extends into interstices in the permeable layer.

14. An anti-fouling covering as claimed in claim 10 wherein the permeable layer is comprised of copper granules.

15. An anti-fouling covering as claimed in claim 10 wherein the permeable layer is comprised of copper wire mesh screen.

16. An anti-fouling covering for preventing the growth of marine organisms on the exterior of submerged objects comprising:

(A) a waterproof adhesive layer covering the surface to be protected when submerged underwater; and (B) a deposit of cayenne pepper material distributed over the adhesive layer and retained in position thereby;

(C) said cayenne pepper material containing repellent properties which create a hostile environment for marine organisms in the area of the submerged object to be protected and which organisms would otherwise attach themselves to the object to be protected.

17. An anti-fouling covering as claimed in claim 16 including an interrupted layer of copper containing material attached to the adhesive layer and retained thereby, the interrupted layer leaving certain areas of the outer surface of the adhesive layer and the cayenne pepper material exposed to the ambient environment of the submerged object through open areas in the interrupted layer.

18. An anti-fouling covering as claimed in claim 17 wherein the interrupted layer is comprised of copper granules adhered to the adhesive layer.

19. An anti-fouling covering as claimed in claim 16 wherein the cayenne pepper material is at least partially imbedded in the adhesive layer.

20. An anti-fouling covering as claimed in claim 16 wherein the cayenne pepper material is liquid oleoresin capsicum which is mixed with the waterproof adhesive layer.

21. An anti-fouling covering as claimed in claim 16 wherein the cayenne pepper material is in particulate form and distributed over the outer surface of the adhesive layer.

22. A protective covering for repelling marine organisms from the exterior of submerged objects comprising:

(A) a waterproof coating formulated to withstand continual submersion under water;

(B) said waterproof coating containing a capsicum derivative material;

(C) said capsicum derivative having repellent properties which create a hostile environment for marine organisms in the area of the submerged object to be protected which would otherwise attach themselves to the object to be protected.

23. A protective covering as claimed in claim 22 wherein the waterproof coating is an ablative paint.

24. A protective covering as claimed in claim 22 wherein the waterproof coating is a urethane formulation.

25. A protective covering as claimed in claim 22 wherein the waterproof coating is an epoxy formulation.

26. A protective covering as claimed in claim 22 wherein the capsicum derivative is particulate cayenne pepper.

27. A method of protecting the surface of underwater objects from fouling by growth of marine organisms thereon comprising the steps of:

(A) applying in liquid form, a waterproof coating formulated to withstand continued submersion under water;

(B) applying to the coating, while wet, a particulate capsicum material; and (C) permitting the coating to dry with the particulate capsicum material adhered thereto.

28. The method as claimed in claim 27 wherein the waterproof coating is an epoxy based paint.

29. The method as claimed in claim 27 wherein the waterproof coating is a urethane composition.

* * * * *